US005528254A

United States Patent [19]

Howng et al.

[11] Patent Number: 5,528,254

[45] Date of Patent: Jun. 18, 1996

[54] ANTENNA AND METHOD FOR FORMING SAME

[75] Inventors: Wei-Yean Howng, Albuquerque, N.M.; Quirino Balzano, Plantation, Fla.

[73] Assignee: Motorola, Inc., Schaumburg, Ill.

[21] Appl. No.: 251,444

[22] Filed: May 31, 1994

[51] Int. Cl.[6] ..... H01Q 1/40

[52] U.S. Cl. ..... 343/873; 343/753

[58] Field of Search ..... 343/873, 785, 343/872, 909, 911 R, 700 MS, 753, 755; H01Q 1/38, 1/40

[56] References Cited

U.S. PATENT DOCUMENTS 4,800,392 1/1989 Garay et al. ..... 343/700

5,155,493 10/1992 Thursby et al. ..... 343/873

5,231,412 7/1993 Eberhardt et al. ..... 343/790

FOREIGN PATENT DOCUMENTS 1555756 11/1979 United Kingdom ..... 343/873

*Primary Examiner*—Michael C. Wimer

*Attorney, Agent, or Firm*—Andrew S. Fuller

[57] ABSTRACT

An antenna (10) includes an antenna element (14) and a composite dielectric structure (13). The composite dielectric structure (13) at least partially envelops the antenna element (14). The dielectric structure (13) is formed to have a gradually decreasing dielectric constant gradient.

10 Claims, 3 Drawing Sheets

ANTENNA AND METHOD FOR FORMING SAME

TECHNICAL FIELD

This invention relates generally to antennas, and more particularly, to antennas for use with communication devices.

BACKGROUND OF THE INVENTION

Communication devices, such as portable radios, are undergoing increasing levels of miniaturization. A typical communication device usually includes an antenna used for receiving and transmitting wireless communication signals. For communication devices operating in the VHF, UHF, and sub-microwave radio frequency ranges, the wavelength of the radio frequency may range between 300 centimeters and 10 centimeters. The communication device requires an antenna of an appropriate length to enable reception or emission of such radio waves. For example, an antenna of simple construction would need to have a conductor having a physical length ranging between 5 and 150 centimeters to accommodate the wavelength of the above-mentioned frequency ranges. For communication devices requiring a compact packaging structure, it might be difficult to accommodate antennas of such lengths. Therefore, it is desirable to have designs which present a physically shorter antenna.

There are many prior art approaches for achieving a shorter physical length antenna. These include the use of helically wound antenna elements, loop antenna elements, and other such designs of varying complexity. Oftentimes, the antenna element is encased for aesthetics, protection, and for other purposes. It is known that if the antenna element is enclosed with a material having a high dielectric constant, the physical length of the antenna required for resonance at certain frequencies is reduced. Such enclosure is known to result in a degradation of performance for the antenna, such as by narrowing the bandwidth, or by reducing the radiation efficiency of the antenna.

It is desirable in the art to have an antenna design with a short physical length suitable for use in miniaturize applications. For some applications, it is also desirable to have a directional antenna. Preferably, this antenna has good performance characteristics and is of simple construction to reduce manufacturing costs.

DETAILED DESCRIPTION OF THE PREFERRED EMBODIMENT

Generally, the present invention provides for an antenna having an antenna element embedded in a composite structure having a dielectric constant gradient. An antenna so constructed allows for an antenna element having a substantially shorter physical length while providing good performance. The antenna of the present invention is particularly useful in designs requiring a miniaturized antenna. The antenna can be monopole, dipole, loop, or other design, while incorporating the concepts taught herein. Moreover, the antenna can be formed to be either symmetric or asymmetric, directional or non-directional, depending on application needs.

Figure 1:
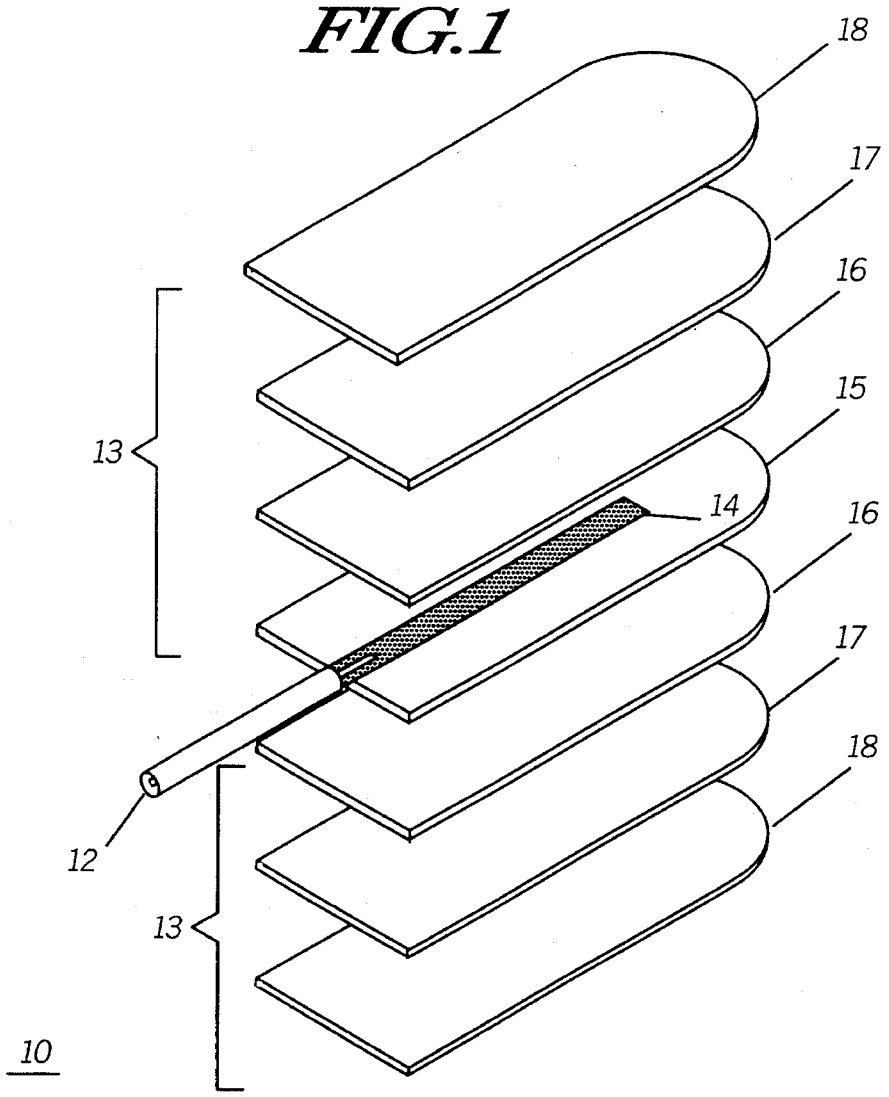
FIG. 1 is an exploded view of an antenna, in accordance with the present invention.

Referring now to FIG. 1, an exploded perspective view of an antenna 10 is shown in accordance with the present invention. The antenna 10 is formed by embedding or sandwiching an antenna element 14 in a composite dielectric structure 13. In the present invention, the antenna element 14 is formed from an elongated conductor which functions both as a radiator and a collector of radio waves. However, the antenna element 14 may assume other designs. For example, the antenna element 14 may include one or more conductors of varying shapes including helical, loop, or other design, depending on a particular application. The antenna element 14 can be embedded or otherwise attached to the dielectric structure 13 such as by plating, or by filling a preformed cavity on the dielectric structure 13, and the like. Alternatively, the dielectric structure 13 may be formed about the antenna element 14. The antenna 10 is fed by an integrated coaxial feedpoint 12.

The length of an antenna can be greatly reduced by enclosing the antenna element in a high dielectric constant matrix. The ratio of the reduction in linear length is proportional to a square root of the relative dielectric constant, i.e., (length in free space)/(length in the dielectric matrix)=$\sqrt{\epsilon}$, where $\epsilon$ is the relative dielectric constant. However, a radio wave traveling between interfacing media to the media interface will experience significant wave reflectivity when the dielectric constants of each of the interfacing media are mismatched, i.e., substantially different for both media. The degree of reflection is a function of the ratio of the respective dielectric constants. Mathematically, it can be expressed as follows:

Coefficient of reflection=$(\sqrt{\epsilon_1}/\sqrt{\epsilon_2})-1)^2/((\sqrt{\epsilon_1}\ /\sqrt{\epsilon_2})+1)^2$ where the symbol $\epsilon_1$ is the dielectric constant of the first medium and $\epsilon_2$ is the dielectric constant of the second medium. As is evident from the equation, the coefficient of reflection is zero(0) when $\epsilon_2=\epsilon_1$, and gradually increases as the dielectric ratio increases or decreases. In the present invention, the reflection is minimized by using a composite dielectric structure 13 having graduated dielectric constants. The composite dielectric structure 13 has a gradually decreasing dielectric constant gradient, and is implemented using multiple layers of dielectric material 15, 16, 17, 18 having a successively smaller dielectric constant. For example, in the preferred embodiment, a layer 15 having a first dielectric constant forms the core in which the antenna element 14 is embedded. A second layer 16 is disposed about the first layer 15 such that the first layer 15 separates the second layer 16 from the antenna element 14. Similarly, a third layer 17 is disposed about the second layer 15 such that the first and second layers 15, 16 separate the third layer 17 from the antenna element 14, and so on. The intent is to keep the dielectric constant ratio as dose to unity as possible at the interface between layers 15, 16, 17, 18 within the composite dielectric structure 13. Moreover, for applications in which the composite dielectric structure 13 functions as a director, it is desirable to have the dielectric constant at the outer portions 18 of the dielectric structure as close as possible to the dielectric constant of the surrounding medium.

Dielectric materials suitable for constructing the multilayer dielectric composite 13 of the present invention include the following: $Mg_{1-x}Ca_xTiO_3$, $\epsilon$=16 to 22; $Sr_{1-x}Ca_xTiO_3$, $\epsilon$=240 to 280; $Ba_2Ti_4O_9\epsilon$=38; $Nd_{1-x}Ba_xTiO_3$, $\epsilon$=75 to 95; $Al_2O_3$, $\epsilon$=6 to 8; and Teflon, $\epsilon$=2 to 4. These materials are representative only and should not be considered an exhaustive list of possible materials. Consider a dielectric composite constructed from multiple layers of dielectric material having dielectric constants of 2, 4, 8, 16, 36, 72, 144, and 288, and having a conductor embedded in that portion having a dielectric constant of 288. With these selected materials, the reflectivity at each interface can be reduced to approximately 0.03, using the formula for the coefficient of reflection stated above. Consequently, the total radio wave transmitted or received through the dielectric composite is the fraction passing through each interface is 0.97 (1.00–0.03) raised to the 8th power (number of interfaces), which results in approximately 78% efficiency. Correspondingly, the physical size of the antenna is shrunk by a factor of 17, i.e., square root of 288 (the dielectric constant of the material enveloping the conductor). The dielectric composite 13 of the embodiment of FIG. 1 is constructed such that a layer of the dielectric material 15 having a high dielectric constant envelops or at least partially envelops the antenna element 14. Additionally, the successive layers of dielectric material 16, 17, 18 have successively smaller dielectric constants such that the dielectric constant of the outer layer 18 approaches that of air.

There are several alternatives for forming the dielectric composite 13. One method includes the use of low radio frequency loss ceramics. The dielectric composite is constructed by laminating layers of ceramic green tapes having different dielectric constants. Another method involves the process of dip-coating a dielectric base with different organic composite dielectrics in a layer by layer construction. Yet another method involves providing a two-component system, one with very high dielectric constant, and one with very low dielectric constant, and having a mixing ratio increasing or decreasing monotonically toward the conductor. For example, a microscopic porosity gradient can be used within a material having a high dielectric constant, i.e., the second dielectric is air and the material becomes increasingly porous toward the preferred direction of wave propagation.

Figure 2:
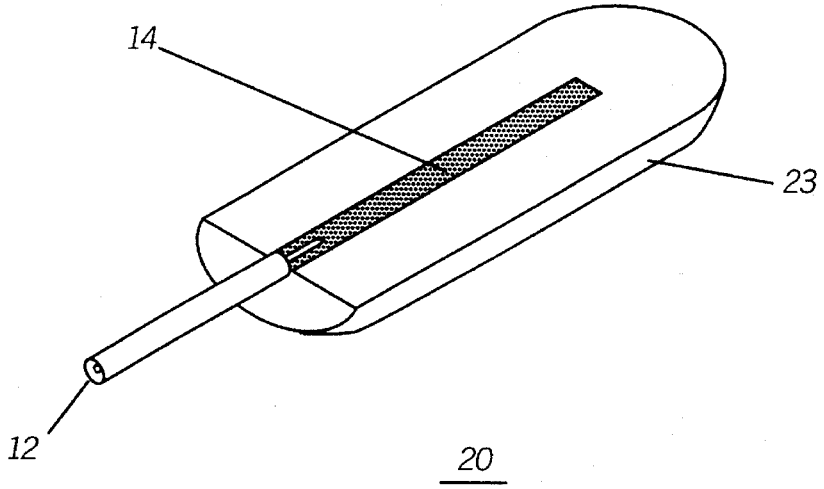
FIG. 2 is a perspective view of an asymmetric directional antenna in accordance with the present invention.
Figure 3:
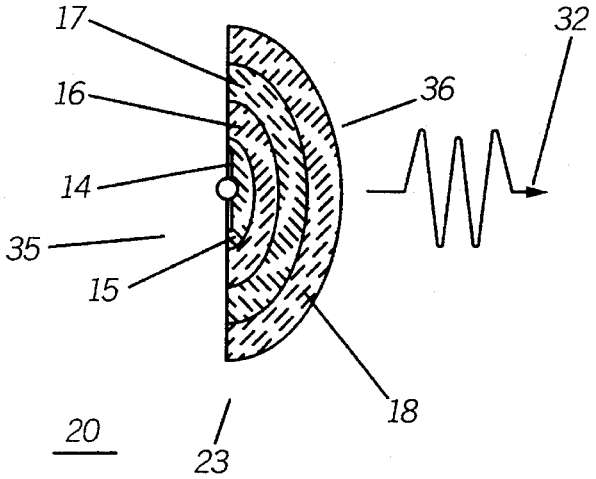
FIG. 3 is a cross-sectional view of the antenna of FIG. 2.
Figure 4:
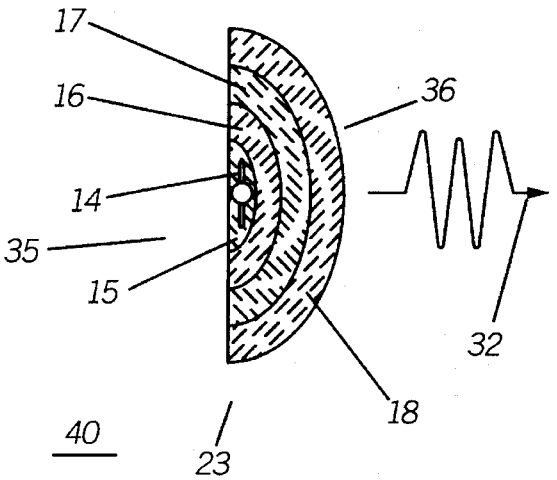
FIG. 4 is a second embodiment of the asymmetric directional antenna, in accordance with the present invention.

In addition to achieving antenna length reduction, the antenna can be made directional. FIG. 2, shows a asymmetrical antenna 20 in accordance with the present invention. FIG. 3 shows a cross-sectional view of the antenna 20 in which the dielectric composite 23 is radially disposed with respect to the antenna element 14. The antenna 20 is termed asymmetric because the composite dielectric structure 23 only partially envelopes the antenna element 14. The resultant structure also forms a directional antenna in which the preferred direction of wave propagation is defined by the composition and shape of the dielectric composite 23, and the relative positioning of the antenna element 14. The antenna 20 is made directional by providing for a dielectric mismatch between the dielectric composite 23 and the surrounding medium where radiation is not desired. The antenna 20 is formed to maximize the dielectric mismatch on one side 35 of the antenna 20, and to minimize the dielectric mismatch on the other side 36 of the antenna 20. Thus, in the embodiment of FIG. 3, the antenna element 14 is embedded in a portion 15 of the dielectric composite 23 having a high dielectric constant. Optionally, the antenna element 14 is fully embedded within the high dielectric constant portion 15, as in the antenna 40 of FIG. 4, to maximize the effect of the dielectric mismatch. Wave propagation is impeded in the direction where material having a high dielectric constant interfaces with the surrounding medium because of the correspondingly high coefficient of reflectivity. In directions where wave propagation 32 is desired, the dielectric constant of the composite material 23 gradually decreases as the distance from the antenna element 14 increases, i.e., in a direction away from the antenna element 14. This configuration provides for a low coefficient of reflectivity at the interface between the antenna 20, 40 and the surrounding medium in such directions. Hence, the antenna 20, 40 is directional and the dielectric composite 23 functions as a director for directing wave propagation.

Figure 5:
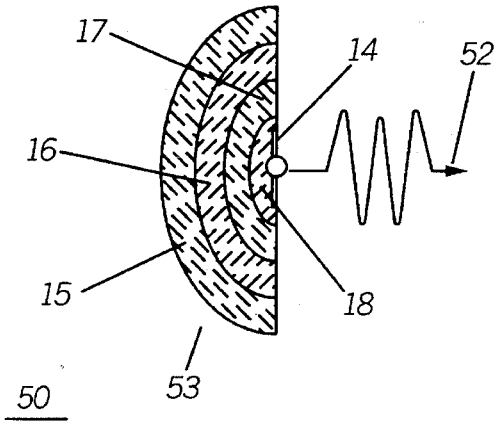
FIG. 5 is an antenna having a reflector portion in accordance with the present invention.

In FIG. 5, a cross-sectional view of a second embodiment of a directional antenna 50 is shown. This antenna 50 uses the dielectric composite 53 to form a reflector for redirecting radiated energy, and for controlling the direction of wave propagation. The dielectric composite 53 is constructed as before, except that the dielectric constant gradient relative to the antenna element 14 is reversed. Accordingly, the dielectric composite 53 has a gradually increasing dielectric constant gradient, i.e., the dielectric constants of the layers 18, 17, 16, 15 are successively larger, as the distance from the antenna element 14 increases, i.e., in a direction toward the antenna element 14. This results in a high coefficient of reflectivity at the interface between the outer layer 15 of the dielectric composite 53 with the surrounding medium where reflectivity is desired. However, wave propagation 52 in the direction away from the reflector through the antenna is relatively unimpeded.

Figure 6:
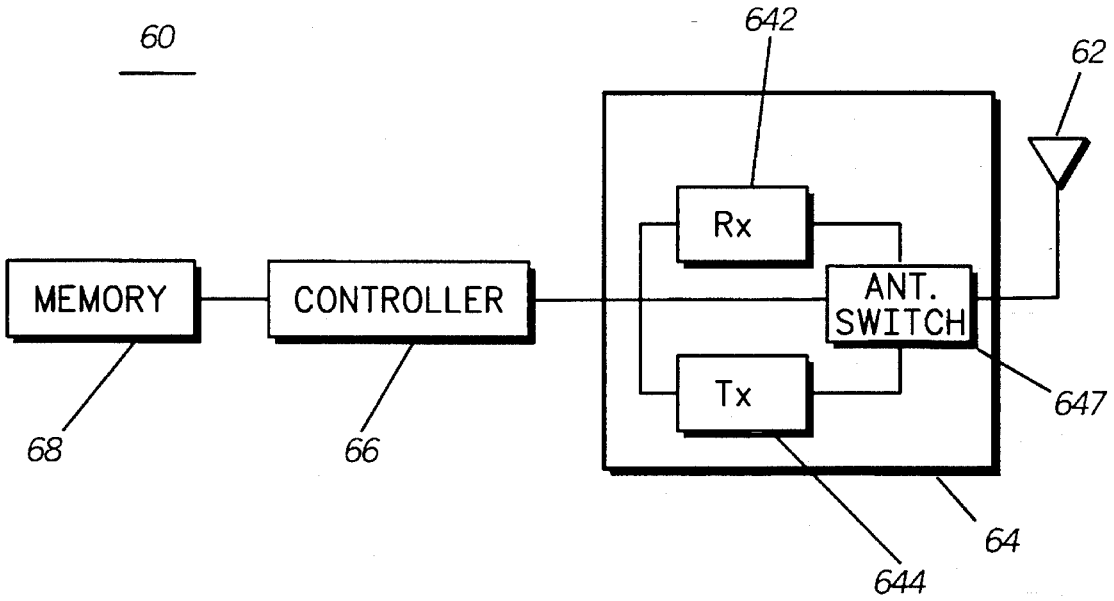
FIG. 6 is block diagram of a radio in accordance with the present invention.

FIG. 6 is a block diagram of a radio which incorporates the antenna of the present invention. The radio 60 is an electronic communication device used for two-way communication, and is capable of receive and transmit operations using well known principles. A controller 66 uses logic and other information from an electrically coupled memory portion 68 to control the overall operation of the radio 60. The controller 66 is electrically coupled to an radio frequency (RF) portion 64 which includes a receiver 642, transmitter 644, and antenna switch 647. The RF portion 64 is electrically coupled, through the antenna switch 647, to an antenna 62 formed in accordance with the present invention (such as the antennas 10, 20, 40, 50 described above). For receive operations, communication signals are received by the antenna 62 and are selectively processed by the receiver 642. Similarly, for transmit operations, communication signals are processed by the transceiver 644 and radiated through the antenna 62. The transmitter 644, receiver 642, and antenna switch 647 operate under the control of the controller 66.

The present invention offers several advantages over the prior art. The composition of the dielectric structure can be selected to achieve a significant reduction in the physical length of the antenna. Additionally, the antenna can be made smaller without sacrificing good performance. Thus, the manufacture of miniaturized communication devices is greatly facilitated. The antenna can be formed to be either directional or non-directional, symmetrical or asymmetrical. This presents significant flexibility for a product designer. Yet, another aspect of the present invention provides for a wave reflector to be formed about the antenna element to allow for more control over the propagation of the radiated waves.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A directional antenna for radiating through a surrounding medium in a preferred direction while impeding radiation in another direction, comprising:

an antenna element; and a composite dielectric structure at least partially enveloping the antenna element, the dielectric structure having first and second interface portions for interfacing with the surrounding medium, and having a first dielectric constant at the first interface portion, and a second dielectric constant at the second interface portion that is substantially closer to a dielectric constant of the surrounding medium than the first dielectric constant, the dielectric structure having a gradually changing dielectric constant gradient from the first interface portion toward the second interface portion;

wherein the composite dielectric structure substantially impedes radiation from the antenna element in a direction toward the first interface portion while permitting radiation from the antenna element in a direction toward the second interface portion.

2. The antenna of claim 1, wherein the composite dielectric structure comprises a plurality of layers of dielectric material of successively smaller dielectric constants.

3. The antenna of claim 1, wherein the dielectric constant gradient gradually decreases between the antenna element and the second interface portion.

4. The antenna of claim 1, wherein the dielectric constant gradient gradually decreases between the first interface portion and the antenna element.

5. The antenna of claim 1, wherein the antenna element is embedded within the first interface portion.

6. The antenna of claim 1, wherein the composite dielectric structure is partially disposed about the antenna element to form an asymmetric antenna.

7. A directional antenna comprising:

an antenna element; and a composite dielectric structure having the antenna element embedded therein, the dielectric structure comprising dielectric material of different dielectric constants formed about the antenna element to establish a high dielectric mismatch in a path between the antenna element and the surrounding medium through a first surface, and a low dielectric mismatch, relative to the high dielectric mismatch, in a path between the antenna element and the surrounding medium through a second surface, such that the dielectric structure promotes wave propagation from the antenna element through the second surface while impeding wave propagation through the first surface.

8. The antenna of claim 7, wherein the dielectric structure further comprises a first dielectric layer having a first dielectric constant, and a second dielectric layer disposed about the first dielectric layer, the second dielectric layer having a second dielectric constant smaller than the first dielectric constant.

9. An antenna, comprising:

an antenna element; and a multi-layer dielectric structure reflector having a first layer of dielectric material at least partially enveloping the antenna element and having successive layers of dielectric material characterized by successively larger dielectric constants in a direction away from the antenna element;

wherein the multi-layer dielectric structure reflector reflects radiation from the antenna element such that reflected radiation propogates through the layers of dielectric material substantially unimpeded in a preferred direction.

10. The antenna of claim 9, wherein:

the dielectric structure is partially disposed about the antenna element.

* * * * *